United States Patent [19]

Nyquist et al.

[11] 4,405,492

[45] Sep. 20, 1983

[54] PROCESS FOR MAKING HIGH-GLYCERIN SOAP BARS

[75] Inventors: John D. Nyquist, Fairfield; Gary K. Kwasniewski, Cincinnati; Arthur W. Thornton, Cincinnati; Paul E. Vest, Cincinnati; Kenneth E. Ducklo, Hamilton, all of Ohio

[73] Assignee: The Procter & Gamble Company, Cincinnati, Ohio

[21] Appl. No.: 360,128

[22] Filed: Mar. 22, 1982

[51] Int. Cl.[3] ..... C11D 9/26; C11D 13/10; C11D 13/18

[52] U.S. Cl. ..... 252/370; 252/108; 252/122; 252/134; 252/DIG. 16

[58] Field of Search ..... 252/108, 122, 132, 134, 252/368, 369, 370, DIG. 16

[56] References Cited

U.S. PATENT DOCUMENTS

| | | | |
|---|---|---|---|
| 3,179,596 | 4/1965 | Farrar et al. | 252/125 |
| 3,835,058 | 9/1974 | White | 252/121 |
| 3,969,259 | 7/1976 | Lages | 252/107 |
| 4,083,796 | 4/1978 | Schubert | 252/132 |
| 4,165,293 | 8/1979 | Gordon | 252/118 |

FOREIGN PATENT DOCUMENTS

| | | |
|---|---|---|
| 512551 | 9/1939 | United Kingdom . |

*Primary Examiner*—Dennis L. Albrecht

*Attorney, Agent, or Firm*—Richard C. Witte; Ronald L. Hemingway

[57] ABSTRACT

A process for making glycerinated toilet bar compositions which are substantially free of hard specks, wherein the soap is worked (e.g., milled) prior to the addition of glycerin.

5 Claims, No Drawings

PROCESS FOR MAKING HIGH-GLYCERIN SOAP BARS

FIELD OF THE INVENTION

The invention relates to a process for making glycerinated milled toilet bar compositions which are substantially free of the gritty feel which can be caused by presence of hard particles of soap ("hard specks") in the bar.

BACKGROUND

Conventionally, milled toilet soaps are made by a process which comprises (1) drying soap having a moisture content of from about 28% to about 30% down to a moisture content of about 7% to about 14%, (2) forming the dried soap into noodles by passing it through a plodder, (3) mixing the various desired additives such as colorants, perfume, etc., into the soap noodles, (4) passing the mixture formed in (3) through a mill or series of mills ("milling" the soap) thereby forming ribbons of soap, (5) passing the milled soap mixture from (5) through a plodder to form a log of soap (i.e., "plodding" the soap), and (6) cutting the log into segments and stamping the segments into the desired bar shape.

The soap which is dried in step (1) can be made from saponification of fats or neutralization of free fatty acids. Because the drying is never completely uniform, the dried soap inevitably contains some particles which are overdried and are harder than the remaining bulk of the dried soap. If the soap also contains free fatty acid, nonhomogeniety of the free acid in the soap can also contribute to the presence of soap particles which are harder than the remaining bulk of the dried soap. The hard particles are generally from about 0.5 to about 10 mm in diameter. These particles remain in the soap through the first plodding step (2) and the mixing step (3). In the milling step (4), the soap is "worked" and the overdried particles are broken down into much smaller particles (generally less than about 0.25 mm in diameter) and are homogeneously distributed throughout the soap mass. In the absence of milling, the finished bar will exhibit a rough or sandy feel during use, due to the slower dissolution rate of the relatively large overdried soap particles, also called "hard specks." When the soap has been properly milled, the overdried soap cannot be detected during use, because it has been reduced to a much smaller particle size and is distributed uniformly throughout the soap mass. See British Pat. No. 512,551, Cruikshank, Sept. 19, 1939, incorporated herein by reference.

Glycerin is a desirable skin conditioning additive for soap bars. It can also be used to impart translucency to the soap. The present inventors have found that when high levels of glycerin (i.e., 2% to 25% of the finished bar) are added to the soap at the conventional place for introducing additives (i.e., in the mixing step prior to milling) the efficiency of the milling process in regard to the breakup and homogeneous distribution of overdried soap particles is greatly reduced. This, in turn, results in finished bars with a high incidence of detectable hard specks. It is believed that the glycerin "lubricates" the overdried soap particles thereby retarding breakup of said particles during the working of the soap which takes place during milling.

Since glycerinated soap is generally softer and more soluble than conventional soap, the presence of hard specks in a glycerinated soap matrix is even more noticeable to the touch than if they are present in a conventional soap bar.

The object of the present invention is to provide a process for making milled toilet bars containing a high level of glycerin and which are substantially free of hard specks.

SUMMARY OF THE INVENTION

The present invention comprises a process for making milled soap bars containing 2% to 25% glycerin, the said process comprising the steps of:

A. Providing a source of soap, dried to an overall moisture content of from about 8% to about 12% and containing particles of soap which are overdried and therefore harder than the remainder of the soap;

B. Mechanically working the soap so as to break-up the overdried soap particles and homogeneously distribute the overdried soap throughout the soap mass;

C. Mixing glycerin into the soap mass;

D. Mechanically working the mixture formed in Step (C);

E. Plodding the mechanically worked mixture of Step (D) into a log; and

F. Cutting the said log into segments and stamping the segments into the desired bar shape.

DETAILED DESCRIPTION OF THE INVENTION

The present invention relates to a process for the production of milled toilet bars which comprise soap and a high level (i.e., about 2% to about 25%) glycerin. Preferably the said bars contain from about 5% to about 15% glycerin.

In Step (A) of the process, soap which has been dried to an overall moisture content of from about 8% to about 12% is provided. The dried soap can be the product of any of the conventional soap drying processes, typical of which are drum drying and spray drying. Such dried soap inevitably contains some overdried particles having a moisture content of from 0% to about 7%. These soap particles are harder and are more difficultly soluble in water than the remainder of the soap. The soap is the alkali metal salt of a $C_{10}$ to $C_{22}$ fatty acid or mixtures of said salts of said acids. The soaps can be produced from direct neutralization of fatty acids with alkali or by saponification of the naturally occurring glycerides. The chemical processes by which soap is made are well known in the art. Examples of suitable soaps are the sodium and potassium salts of lauric, myristic, palmitic, oleic and stearic acids and mixtures thereof. Preferred soaps are the sodium and mixed sodium and potassium salts of fatty acids derived from coconut oil and tallow, which has been hydrogenated to an I.V. of from about 18 to about 40. Preferred toilet bar compositions herein are those wherein the soap portion of the composition comprises from about 20% to about 50% soaps of coconut fatty acids and from about 50% to about 80% soaps of hydrogenated tallow fatty acids. If it is desired that the finished bar contain free fatty acid, the free fatty acid can be added to the soap before drying or it can be added along with the glycerin in Step (C), below.

In Step (B) of the process, the soap from Step (A) is physically worked so as to break up the overdried soap particles and homogeneously distribute the dried soap throughout the soap mass. Before working, the overdried particles will generally have a particle size of from about 0.5 mm to about 10 mm in diameter, or in the longest dimension if the particle is not generally spherical. After working, the overdried soap particles have particle size of about 0.25 mm or less in diameter, or in the longest dimension. The working can be accomplished, inter alia, by extruding the soap through a soap refining screen or by milling the soap on a conventional soap mill. As is well known in the art, a soap refining screen is a metal plate which is perforated with a large number of holes, typically having diameters of from about 0.153 mm to about 3.63 mm. The soap is pressed through the screen, thereby working the soap so as to break up the overdried soap particles and distribute the overdried soap throughout the soap mass. As is also well known in the art, a soap mill comprises one or more pairs of rollers (typically made of stainless steel) through which the soap is passed and thereby compressed into ribbons. The working of the soap, which occurs as it is passed between the rollers, breaks up the overdried soap particles and distributes the overdried soap throughout the soap mass. A commercially available soap mill is the Lehmann Model 924SA, manufactured by Lehmann-Thropp Division of Mullins Manufacturing. The temperature of the soap during working is typically from about 32° C. to about 52° C.

In Step (C), glycerin is mixed into the soap. The mixing can take place in any type of conventional soap mixing equipment, for example, such as the MS/S Model Amalgamator manufactured by Mazzoni S.P.A. Any other desired additives can also be mixed into the soap at this time. Typical additives are the following: colorants in amounts up to about 1.0%; perfumes in amounts up to about 1.5%; antimicrobial agents such as trichlorocarbanilide at levels up to about 1.0%; free fatty acid such as coconut fatty acids at levels up to about 10%; synthetic detergents such as sodium $C_{10}$ to $C_{18}$ alkyl sulfates and alkyl benzene sulfonates at levels up to about 50%; and emollients such as lanolin and fatty triglycerides at levels up to about 10%. Preferably, the milled base noodles from Step (B) should not be allowed to cool to less than about 24° C. prior to the addition of glycerin and other bar components in Step (C).

In Step (D) the mixture from Step (C) is worked in order to more completely distribute the materials added in Step (C) throughout the soap composition. (See Step (B)) The temperature during working is from about 27° C. to about 52° C. The working in Step (D) can be by means of a mill or a refining screen as in Step (B). Preferably the working is accomplished by means of a mill.

In Step (E) the soap composition from Step (D) is plodded into a soap log by passing it through a conventional soap plodder. A typical plodder is the Duplex Model M400-2/M400-4 plodder manufactured by Mazzoni S.P.A. of Busto Arsizio, Italy.

In Step (F) the soap log is cut into segments and these segments are stamped in the conventional manner into toilet bars of the desired shape.

In this process, the overdried soap particles are broken up and the overdried soap is homogeneously distributed throughout the soap mass before glycerin is added; thus, there is no opportunity for glycerin to exert a lubricating effect on the particles which would inpede their break-up during the working of the soap.

The foregoing process can be used to produce high-glycerin toilet bars which are uniform in color and composition, in which case a single soap composition is passed through the process. Alternatively, marbleized toilet bars can be produced by subjecting one color soap composition to Steps (A), (B), (C) and (D) in one manufacturing line and subjecting a second color soap composition to Steps (A), (B), (C) and (D) in a second manufacturing line, bringing the two compositions together in Step (E) and then continuing on with Step (F). A more detailed disclosure of the manufacture of marbleized toilet bars is found in U.S. Pat. No. 3,993,722, Borcher et al., issued Nov. 23, 1976, incorporated herein by reference. In practice, there is usually enough "scrap" soap produced in the cutting and stamping operation (Step F) that this soap can be mixed with additional colorant, opacifier, etc., and recycled back into Step (E) as the second color soap, thereby eliminating the need for maintaining continuous operating of a complete processing line for making the second color soap. For example, in making a marbleized bar in which one soap is translucent and the other opaque, a complete processing line can be maintained for producing translucent soap and the "scrap" from Step (F) can be mixed with an appropriate amount of opacifying pigment and recycled back into Step (E) where it is blended with translucent soap and plodded to form a marbleized log of translucent and opaque soap.

The invention will be further illustrated by the following example.

EXAMPLE I

In this example, superfatted milled soap bars containing about 10% glycerin were produced by two different methods. Case I utilized a normal milled bar making process. Case II utilized the process of the invention wherein the base soap was milled prior to the addition of glycerin. In both cases, the nominal composition of the finished product was as follows:

| Component | Wt. % |
|---|---|
| Sodium Soap (50% Tallow/50% Coconut) | 71.65 |
| Coconut Fatty Acid | 6.55 |
| Glycerin | 10.00 |
| Perfume | 1.40 |
| NaCl | 1.04 |
| Preservative | 0.06 |
| Moisture | 9.3 |
| Colorants | 0.000155 |

Base soap noodles for both cases were prepared by drying a solution of soap, coconut fatty acid, NaCl, and water on a Mazzoni 2-stage vacuum dryer. These base soap noodles contained about 11% moisture, 7.4% free fatty acid, and 0.68% NaCl.

In Case I, these base soap noodles were mixed with glycerin, perfume, preservative, colorants, and additional NaCl in an amalgamator. This mixture was passed through a 4-Roll Lehmann soap mill. The flake thickness on the top roll was 0.007 in. and the temperature of the soap was 31.7° C. This milled composition was vacuum plodded and stamped into bar form.

In Case II, the base soap noodles were first passed once through a Lehmann 4-Roll soap mill. The top roll flake thickness was about 0.008 inches. The soap entered the mill at a temperature of 37.8°–38.3° C. and left the mill at a temperature of about 40°–41.7° C. Glycerin, perfume, preservative, colorants, and additional NaCl were added to the milled soap via an amalgamator. This mixture was then passed through a 4-Roll Lehmann soap mill. The flake thickness of the top roll was about 0.007 inches. The temperature of the soap was 31.1° C. This milled composition was vacuum plodded and stamped to bar form.

The bars produced in both Case I and Case II were evaluated for bar feel according to the following test procedure.

A 1 gallon container is placed under a dual-hot-cold water tap. Water temperature is adjusted to 26.7° C.±1.1° C. The container is filled with water at this temperature and allowed to continuously overflow the container. The bar is placed between the hands, submerged in the container at a point near where the stream of water is entering the container, but not directly under the stream, and the bar is rubbed between the hands in a normal hand washing motion for one minute. This treatment removes surface roughness and sharp edges. While still submerged in the water, the bar is revolved in one hand for 10 seconds while feeling for dragginess or areas of sandiness or roughness, as well as for individual large hardspecks. Using the feel impression generated during this 10 second period, the bar is graded using the scale below.

The bar is graded according to the number that most nearly describes the feel of the sample. If the bar exhibits two types of defects of unequal severity, the number based on the worst fault is reported. For example, if a bar exhibits "moderate overall sandiness" and "more than 20 specks," the grade reported is "4." If a bar exhibits two types of defects of equal severity, the number reported is 1 unit lower than given in the scale. For example, if the bar exhibits "moderate overall sandiness" and "6-10 specks," the grade reported is "5."

| Bar Feel Grading Scale | |
|---|---|
| 10 | Perfectly smooth and slippery. |
| 9 | Practically smooth or one speck. |
| 8 | Barely detectible, sandiness, roughness, dragginess, or 2-3 specks. |
| 7 | Slight sandiness, roughness, dragginess, or 4-5 specks. |
| 6 | Moderate overall sandiness, roughness, dragginess, or 6-10 specks. |
| 5 | Quite noticeable overall sandiness, roughness, dragginess, or 10-20 specks. |
| 4 | Pronounced overall sandiness or roughness or more than 20 specks. |
| 3 | Pronounced overall coarse sandiness or roughness (like LAVA). |
| 2 | Extreme overall coarse sandiness or roughness. |
| 1 | Extreme overall abrasive roughness. |

The bar feel grades for the bars produced in Case I and Case II are shown in the table below. The grades are an average for 2 bars in each Case.

| | Feel Grade |
|---|---|
| Case I | 5 |
| Case II | 10 |

What is claimed is:

1. A process for making milled soap bars containing 2% to 25% glycerin, the said process comprising the steps of:

A. Providing a source of soap, dried to an overall moisture content of from about 8% to about 12% and containing particles of soap which are overdried and therefore harder than the remainder of the soap;

B. Mechanically working the soap by milling it or extruding it through a soap refining screen so as to break up the overdried soap particles and homogeneously distribute the overdried soap throughout the soap mass;

C. Mixing glycerin into the soap mass;

D. Mechanically working the mixture formed in Step (C) by milling it or extruding it through a soap refining screen;

E. Plodding the worked mixture of Step (D) into a log; and

F. Cutting the said log into segments and stamping the segments into the desired bar shape.

2. The process of claim 1 wherein the glycerin level is from about 5% to about 15%.

3. The process of claim 2 wherein in Step (B) the mechanical working is accomplished by milling the soap.

4. The process of claim 3 wherein in Step (D) the mechanical working is accomplished by milling the soap.

5. The process of claims 3 or 4 wherein the total soap composition contains from about 8% to about 12% moisture and wherein the soap portion of the composition comprises from about 20% to about 50% coconut soap and from about 50% to about 80% hydrogenated tallow soap.

* * * * *